US006283548B1

(12) United States Patent
Husemann

(10) Patent No.: US 6,283,548 B1
(45) Date of Patent: Sep. 4, 2001

(54) OFFICE CHAIR WITH A GUIDABLE SEAT BACK

(75) Inventor: Dirk Husemann, Bad Essen (DE)

(73) Assignee: Drabert GmbH, Minden (DE)

( * ) Notice: Subject to any disclaimer, the term of this patent is extended or adjusted under 35 U.S.C. 154(b) by 0 days.

(21) Appl. No.: 09/422,490

(22) Filed: Oct. 21, 1999

(30) Foreign Application Priority Data

Oct. 21, 1998 (DE) ..... 198 49 521

(51) Int. Cl.[7] ..... A47C 1/024

(52) U.S. Cl. ..... 297/300.1; 297/300.4; 297/300.7; 297/302.7

(58) Field of Search ..... 297/300.1, 300.4, 297/300.7, 302.3, 302.7, 303.3, 300.8

(56) References Cited

U.S. PATENT DOCUMENTS 4,479,679 * 10/1984 Fries et al. ..... 297/300.7 X
4,889,384 * 12/1989 Sulzer ..... 297/302.7 X
4,909,472 * 3/1990 Piretti ..... 297/302.7 X
5,160,184 * 11/1992 Faiks et al. ..... 297/300.7 X
5,601,336 * 2/1997 Troyas-Bermejo ..... 297/300.4
5,909,924 * 6/1999 Roslund, Jr. ..... 297/300.4

FOREIGN PATENT DOCUMENTS

3900220 A1 7/1990 (DE) .
4038072 A1 6/1992 (DE) .
196 42 993 A1 4/1997 (DE) .

* cited by examiner

*Primary Examiner*—Milton Nelson, Jr.
*Assistant Examiner*—Stephen Vu
(74) *Attorney, Agent, or Firm*—Salter & Michaelson

(57) ABSTRACT

An office chair is provided. The office chair includes a seat back that can follow the motions of the upper body of a person seated in the seat. The seat back of the office chair includes a restoring spring in the form of a mechanical screw pressure spring. A piston is coaxially disposed in the screw pressure spring. The piston inserts in a piston sleeve, whereby the piston has locking pieces that can be extended radially to the outside, which are placed on the peripheral edge of the piston sleeve in the hooked-out state and in a largely extended position of the piston.

9 Claims, 2 Drawing Sheets

OFFICE CHAIR WITH A GUIDABLE SEAT BACK

DESCRIPTION

1. Technical Field

The invention concerns an office chair with a seat back, whose seat back carrier is mounted around a horizontal axis so that it can be turned on a chair carrier held in a stationary manner, such that the seat back carrier can be turned backward against the pressure of a restoring spring and by means of the restoring force, the restoring spring following a frontward-directed motion of the upper body of the person seated in the seat.

2. Background of Related Art

Chairs of this type are built for the purpose of dynamic seating and are also particularly known to have a synchronous mechanism, in which both the seat back carrier as well as the seat carrier turn synchronously around horizontal axes.

A particular feature of such office chairs with trackable, i.e., guidable, seat backs consists of the fact that for specific office operations, in which the back of the person seated in the seat requires a static support, the seat back carrier can be locked in a frontward-turned position by means of a locking device.

Known office chairs thus use as a restoring spring for the seat back carrier such as a gas-pressure-actuated spring, which can be locked in any position by blocking its overflow valve. This is an advantage, but it is accompanied by the disadvantage that the respective flow-through opening of the overflow valve attenuates the forward and restoring motions of the seat back or of the seat back carrier. Thus, the dynamics of the seat motions that can be conducted are also attenuated and in particular, the attenuated restoring movement of the seat back is not usually in agreement with the greater dynamic movement of the person seated in the seat.

In order to counteract this disadvantage of gas-pressure-actuated springs, it is known to combine a gas-pressure-actuated spring with a cylindrical screw pressure spring, which coaxially surrounds the gas-pressure-actuated spring as an outer metal spring, in order to endow the latter with more dynamics by a corresponding support of the force. However, such a spring assembly is also not appropriate for the required rapid tracking of the seat back for a large proportion of dynamically inclining users of the seat.

Therefore, there is needed in the art a new restoring spring or a new spring assembly which has the desired greater dynamics and, as previously, can be blocked or locked in a position of the seat back carrier that is turned toward the front. In addition, the new restoring spring, or the desired new restoring spring assembly, should have the same external structural dimensions, mounting connections and operational courses, in order to be able to optionally exchange with a gas-pressure-actuated spring or a gas-pressure-actuated/metal spring assembly of the known structural type.

SUMMARY

According to the present invention, there is provided a restoring spring which is designed in the form of a mechanical screw pressure spring and which is arranged between a thrust bearing assigned to the seat back carrier and a thrust bearing assigned to the chair carrier. A piston attached to one of the thrust bearings is provided which inserts into a piston sleeve attached in the other thrust bearing, whereby the piston has radial locking catches that hook out toward the outside, and sit on the peripheral edge of the piston sleeve in the hooked-out state in a largely extended position.

The new piston-lockable metal pressure spring can also be combined with an additional outer screw pressure spring, which coaxially encloses the inner-lying first metal pressure spring, to form a metal spring assembly, as can be derived from the drawings of this application. The great dynamics of the metal pressure springs are always fully utilized for the rapid tracking of the seat back or the seat back carrier of an office chair, so that there are no deficits in the dynamics of the office chair of the type according to the invention.

The piston-locking of the metal pressure spring assures that the seat back carrier can be locked without problem in a forward position of the seat back, in a way familiar to the person who uses the seat, since it is similar to the old gas-pressure-actuated spring technique.

According to one embodiment of the invention, the locking catches that can hook out from the piston are provided by the end pieces of a spring-apart scissors, which is mounted in the piston and the end pieces of which extend from the peripheral surface of the piston when the manipulation ends of the spring-apart scissors are pressed together.

Such a spring-apart scissors (de facto there are two rocker arms running in opposite directions and move around a common claw axis) has the advantage that the manipulation ends of the spring-apart scissors can be pressed together in the simplest way and permanently by spring force. As long as the piston with its piston region in which the end pieces of the spring-apart scissors are positioned is found inside the piston sleeve, the end pieces defined as the locking catches are ineffective, since they only slide along on the inner wall of the piston sleeve. The end pieces can be effective only for the desired positioning of the seat back turned toward the front, i.e. if they are pulled out of the piston sleeve and are seated as locking catches on the peripheral surface of the piston sleeve.

This neutralizing of the effect of the permanently prestressed spring-apart scissors by the piston sleeve has the operating advantage for the person seated in the seat that at any time and in any seat position, he or she can activate the locking device for locking the seat back in a position turned frontward, whereby subsequently the locking of the seat back occurs automatically only if the front turning position of the seat back has been achieved.

If the locking will again be removed, then the manipulation ends of the spring-apart scissors permanently pressed together by means of spring force are again pressed apart by pushing in a feed wedge, whereby the end pieces of the spring-apart scissors are then retracted into the piston and the piston can retract into the piston sleeve.

If the locking will be removed for an indefinite period of time, then the feed wedge can be mechanically fixed in its advanced position, in which it presses apart the manipulation ends of the spring-apart scissors.

In another embodiment of the new piston-lockable metal pressure spring, the peripheral edge of the piston sleeve has gradations, which are shaped corresponding to the width of the locking pieces and are offset relative to one another in the axial direction of the piston sleeve, so that another graduated peripheral edge of the piston sleeve can be utilized each time for seating of the locking pieces by means of a rotational movement of the piston sleeve around its axis. Correspondingly, the person seated in the seat can select or adjust the front locking position of the seat back that he or she prefers.

Alternatively to the above-described use of a spring-apart scissors in the piston, according to claim 6, it can also be provided that the locking pieces mounted in the piston are formed by one or more pneumatically extendible and retractable adjusting pistons, which communicate with an extendible and retractable control piston by means of a compressed-air-tight connection tubing.

BRIEF DESCRIPTION OF THE DRAWINGS

It should be understood that the drawings are provided for the purpose of illustration only and are not intended to define the limits of the invention. The foregoing and other advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
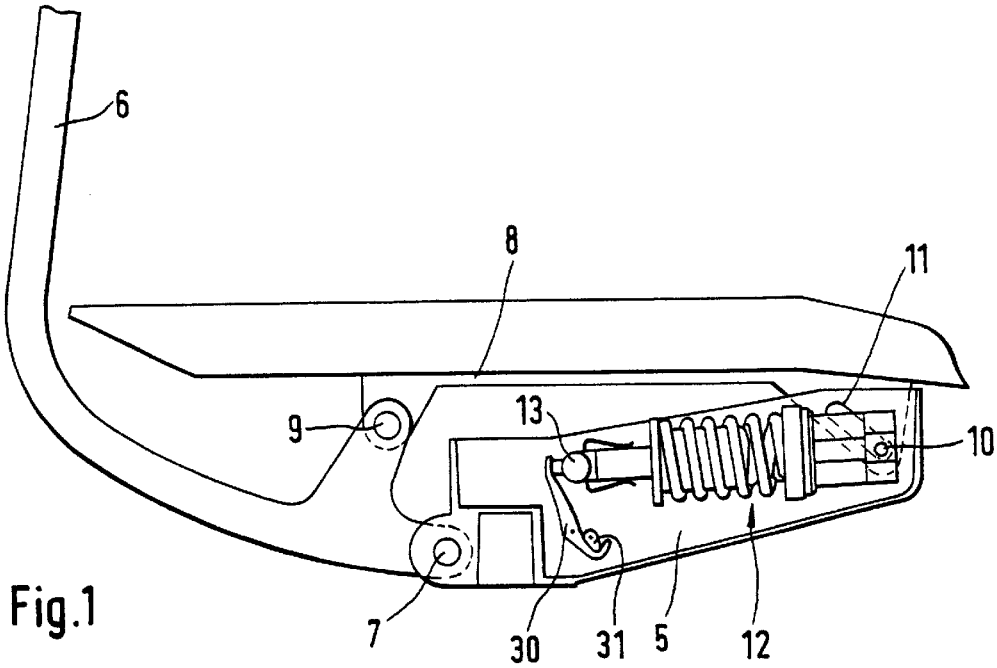
FIG. 1 shows a simplified lateral view of an office chair with trackable seat back.

The chair carrier 5 of an office chair with a trackable seat back carrier 6 which can be turned around axis 7, and a seat carrier 8 that can be turned synchronously therewith, is shown in a simplified lateral view in FIG. 1. Thus, the synchronous adjustment can be conducted if seat back carrier 6 is joined with seat carrier 8 by means of axle 9. The seat carrier possesses on its front end a sliding axle 10 arranged rigidly on it, which axle is guided in two congruent oblong-slot, radial cams 11 in the side walls of seat carrier 5. The radial cams run from a downward direction in the front to an upward direction in the back, so that an increasing displacement path of the sliding axle 10 is produced, when the seat back carrier 6 is moved from its front seat-back position shown into its back seat-back position (not shown).

One of the thrust bearings of spring assembly 12 is coupled to sliding axle 10 of seat carrier 8, which is effectively joined with seat back carrier 6. The other thrust bearing of spring assembly 12 is provided by cross-axle 13 in chair carrier 5.

Figure 2:
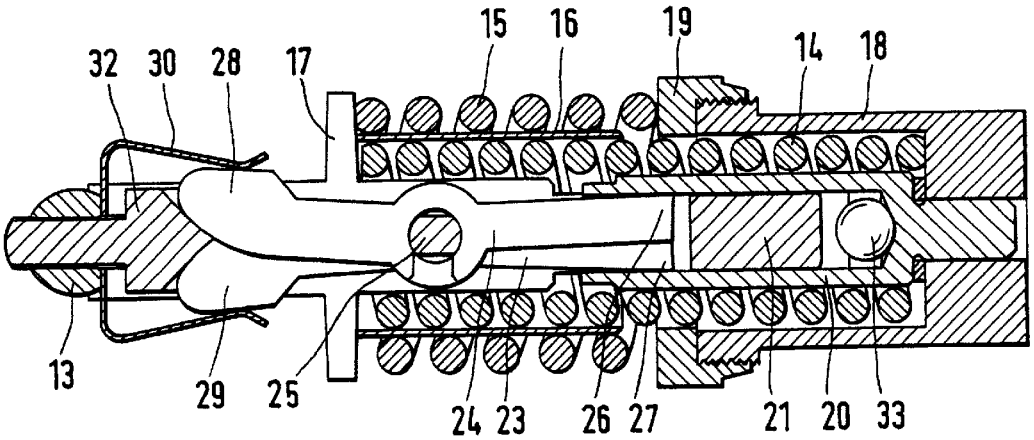
FIG. 2 shows a longitudinal section through a piston-lockable metal spring assembly according to the invention.
Figure 3:
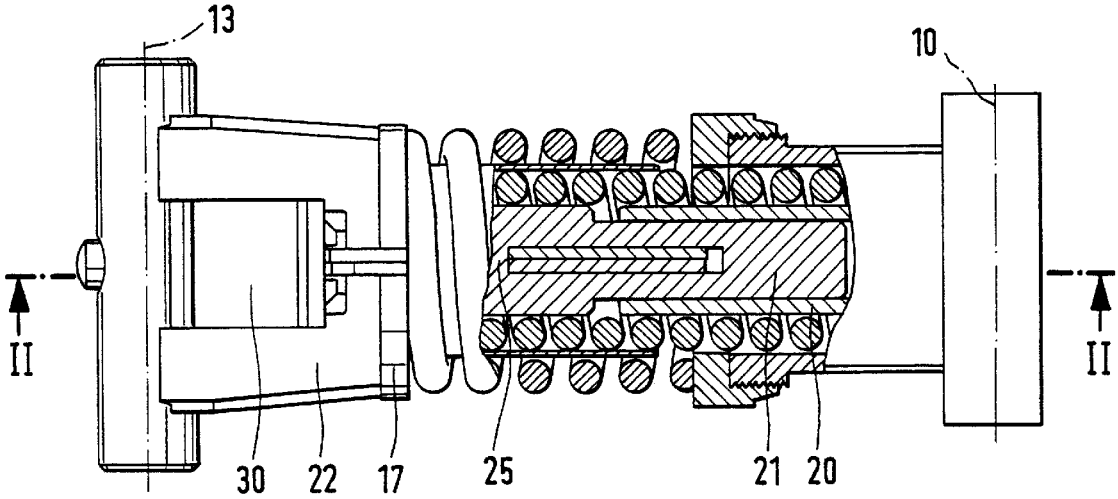
FIG. 3 shows a side view rotated by 90° with partial sectional representation of the spring assembly according to FIG. 2.
Figure 4:
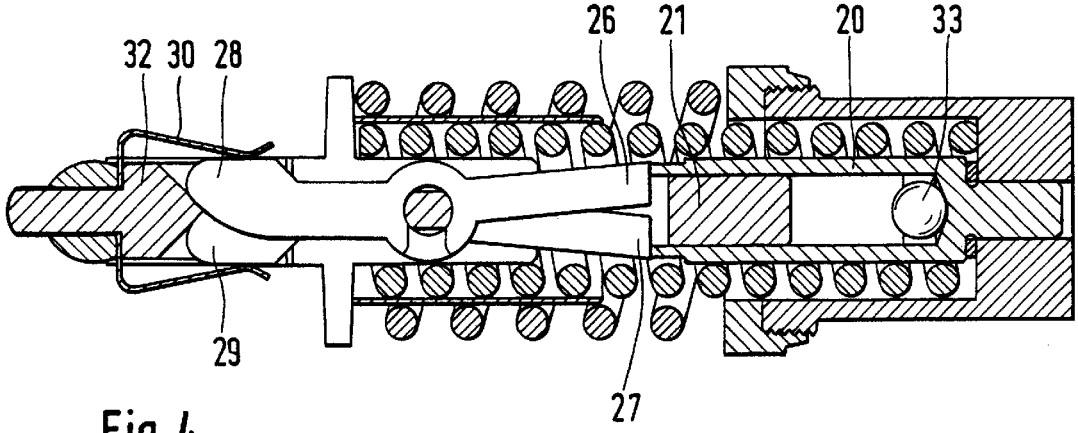
FIG. 4 shows the spring assembly according to FIG. 2 in its locking position.

Spring assembly 12 is shown in more detail in FIGS. 2 to 4. Spring assembly 12 is comprised of an inner cylindrical screw pressure spring 14 and an outer screw pressure spring 15 arranged coaxially to the first spring. Both springs are separated from one another by tube piece 16. The inner screw pressure spring is clamped between curved, plate washer 17 and (pot-shaped) housing 18. The outer screw pressure spring 15 lies, on the one side, on plate washer 17 and, on the other side, on the male fitting cover 19. Male fitting cover 19 can be adjusted axially on the outer thread of (pot-shaped) housing 18 for the purpose of changing the pre-stress of the outer screw pressure spring 15.

On the inside of the inner cylindrical screw pressure spring 14, a piston sleeve 20 is present, which is rigidly joined with the right thrust bearing as shown (which is sliding axle 10). A piston 21 attached to the left thrust bearing (which is cross-axle 13) is inserted into this piston sleeve.

Piston 21 is made up in one piece with plate washer 17 and stationary crosshead 22 shown on the left. It has a slot-type routing, in which the two rocker arms 23 and 24 of a spring-apart scissors are set on the claw axis 25. The end pieces 26 and 27 of the spring-apart scissors, in the position of the piston shown in FIG. 2, are inserted into the piston sleeve 20, but they are placed on the peripheral edge of piston sleeve 20 in the position of the piston shown in FIG. 4.

The manipulation ends 28 and 29 of the spring-apart scissors are permanently loaded by the U-shaped leaf spring 30, so that end pieces 26 and 27 permanently have the tendency to extend radially outward from the routing of the piston 21 and can be set on the peripheral edge of piston sleeve 20, as soon as the position of the piston extended maximally from the piston sleeve permits this. The spring assembly is then blocked, i.e., the seat back carrier 6 of the office chair is then locked.

In order to unlock the seat back carrier 6, the person seated in the seat must actuate a lever device 30/31 (see FIG. 1) in the known way, which acts on feed wedge 32 by means of which the manipulation ends 28 and 29 of the spring-apart scissors can be moved apart from one another against the pressure of the U-shaped leaf spring 30, so that end pieces 26 and 27 of the spring-apart scissors are again found in their position retracted into the routing of the piston, in which they can be retracted into piston sleeve 20 along with piston 21. The rubber balls 33 present on the bottom of the piston sleeve serve as an end stop for the retraction of the piston into the piston sleeve.

The lever arrangement 30/31 in chair carrier 5 of the office chair is constructed in the known way, so that the larger lever 30 can be brought into a permanent position (holding position) in which larger lever 30 mechanically fixes the feed wedge 32 in the position according to FIG. 2, in which a locking of seat back carrier 6 is not possible, by means of an at-least 90° turn of the smaller lever 31.

It will be understood that various modifications may be made to the embodiment disclosed herein. Therefore, the above description should not be construed as limiting, but merely as exemplifications of a preferred embodiment. Those skilled in the art will envision other modifications within the scope spirit of the invention.

What is claimed is:

1. An office chair with a chair back, whose chair back carrier is mounted on a chair carrier that is held stationary so that it can turn around a horizontal axis such that the seat back carrier can be turned backward against the pressure of a restoring force, and that follows a frontward-directed motion of the upper body of the person seated on the seat, said chair comprising:

a restoring spring constructed and arranged to apply the restoring force and shaped in the form of a mechanical screw pressure spring, which is arranged between a thrust bearing assigned to the seat back carrier and a thrust bearing assigned to the chair carrier, a piston attached to one of the thrust bearings coaxially in the screw pressure spring, and insertable into a piston sleeve attached to the other thrust bearing; and first and second locking pieces that are extendable radially outward from the piston and which are placed on a peripheral edge of piston sleeve in a hooked-out state in a substantially extended position of the piston;

wherein the seat back carrier can be locked into a frontward turned position by engagement of the locking pieces.

2. The office chair according to claim 1, wherein the piston sleeve can be rotated around its axis and that the peripheral edge of the piston sleeve has gradations, which are formed corresponding to the width of each of the first and second locking pieces and are offset relative to one another in the axial direction.

3. The office chair according to claim 1, wherein the locking pieces are provided at first and second end pieces of a spring-apart scissors, which is mounted in a piston and whose end pieces extend out from a peripheral surface of the piston when first and second manipulation ends of the spring-apart scissors are pressed together.

4. The office chair according to claim 3, wherein the pressing together of the first and second manipulation ends of the spring-apart scissors is permanently produced by a spring force and the first and second manipulation ends of the spring-apart scissors are pressed apart by means of a feed wedge to retract the first and second end pieces of the spring-apart scissors into the piston.

5. The office chair according to claim 4, wherein the feed wedge can be mechanically fixed in its advanced position, in which it presses apart the first and second manipulation ends of the sprig-apart scissors.

6. The office chair according to claim 1, wherein the first and second locking pieces are formed by one or more pneumatically extendible and retractable adjusting pistons, which communicate, by means of a compressed-air-tight connection tubing, with an extendible and retractable control piston.

7. An office chair with a chair back, whose chair back carrier is mounted on a chair carrier that is held stationary so that it can tun around a horizontal axis such that the seat back carrier can be turned backward against the pressure of a restoring force, and that follows a frontward-directed motion of the upper body of the person seated on the seat, said chair comprising:

a restoring spring constructed and arranged to apply the restoring force and shaped in the form of a mechanical screw pressure spring, which is arranged between a thrust bearing assigned to the seat back carrier and a thrust bearing assigned to the chair carrier, a piston attached to one of the thrust bearings coaxially in the screw pressure spring, and insertable into a piston sleeve attached to the other thrust bearing; and wherein first and second locking pieces are provided at first and second end pieces of a spring-apart scissors, which is mounted in a piston and whose end pieces extend out from a peripheral surface of the piston when first and second manipulation ends of the spring-apart scissors are pressed together, the first and second locking pieces being extendable radially outward from the piston and placed on a peripheral edge of the piston sleeve in a hooked-out state in a substantially extended position of the piston;

wherein the pressing together of the first and second manipulation ends of the spring-apart scissors is permanently produced by a spring force and the first and second manipulation ends of the spring-apart scissors are pressed apart by means of a feed wedge to retract the fist and second end pieces of the spring-apart scissors into the piston;

wherein the seat back carrier can be locked into a frontward turned position by engagement of the locking pieces.

8. The office chair according to claim 7, wherein the feed wedge can be mechanically fixed in its advanced position, in which it presses apart the first and second manipulation ends of the spring-apart scissors.

9. The office chair according to claim 8, wherein the locking pieces are formed by one or more pneumatically extendible and retractable adjusting pistons, which communicate, by means of a compressed-air-tight connection tubing, with an extendible and retractable control piston.

* * * * *